US005659990A

United States Patent [19]

Henneman et al.

[11] Patent Number: 5,659,990

[45] Date of Patent: Aug. 26, 1997

[54] RETAINER FOR ART FRAME

[76] Inventors: Barbara Henneman, 3142 Montpelier Ct., Pleasanton, Calif. 94588; Rebecca McLaughlin, 1613 Monterey Dr., Livermore, Calif. 94550

[21] Appl. No.: 406,169

[22] Filed: Mar. 17, 1995

[51] Int. Cl.[6] ..... A47G 1/16

[52] U.S. Cl. ..... 40/795; 40/790

[58] Field of Search ..... 40/156, 790

[56] References Cited

U.S. PATENT DOCUMENTS

| | | | |
|---|---|---|---|
| 648,523 | 5/1900 | Pierce . | |
| 2,632,971 | 7/1953 | Manczek et al. . | |
| 3,180,388 | 4/1965 | Newcomer, Jr. et al. | 411/353 |
| 4,045,898 | 9/1977 | Reinhardt . | |
| 4,270,287 | 6/1981 | Gimbel . | |
| 4,466,206 | 8/1984 | Meadows . | |
| 4,704,814 | 11/1987 | Astolfi . | |
| 4,953,312 | 9/1990 | Astolfi . | |
| 4,980,983 | 1/1991 | Champley . | |
| 5,052,136 | 10/1991 | Poggiolini . | |

FOREIGN PATENT DOCUMENTS

| | | | |
|---|---|---|---|
| 331061 | 12/1920 | Germany | 40/156 |
| 618051 | 8/1935 | Germany | 40/156 |
| 281970 | 3/1952 | Switzerland | 40/156 |
| 158167 | 2/1921 | United Kingdom | 40/700 |

*Primary Examiner*—Kenneth J. Dorner
*Assistant Examiner*—Cassandra Davis
*Attorney, Agent, or Firm*—Harris Zimmerman

[57] ABSTRACT

A retainer for securing artwork in a picture frame includes a spring capable of engaging all four side rails of a picture frame in compressive fashion. The spring is formed in the configuration of a four pointed star, each point of the star joined to an adjacent point by a pair of diverging, arcuate, concave arms. All of the points and the joining arms are disposed in a common plane. The entire star configuration is formed of spring wire or the like, and is preferably formed in integral, unitary fashion. The points of the star are each formed by a convex bend in the spring wire, the convex bend having a radius significantly smaller than the radii of any of the linking arms of the star. At each point the apex is ground or otherwise formed to define a sharpened edge which penetrates the picture frame material. The star is dimensioned to be slightly larger that the length and width of the inner opening of the picture frame. The relatively large radii of the linking arms imparts a resilient flexibility to the star, so that the star may be deformed and compressed to fit within the opening of the back of the picture frame. The star-shaped device then springs outwardly, forcing the sharpened edges of the points into the inner surfaces of the frame. The retainer is placed so that it impinges directly on the exposed surface of the artwork assembly, so that the artwork is maintained in impingement against the glazing of the picture frame. This engagement will be maintained securely and indefinitely, or may be selectively removed and replaced with little effort.

2 Claims, 1 Drawing Sheet

RETAINER FOR ART FRAME

BACKGROUND OF THE INVENTION

This invention generally relates to frames for artwork, photographs, and the like, and more specifically to a device for securing the glazing, artwork, and backing in a typical wooden frame.

In the assembly of framed artwork, such as photographs, prints and paintings and the like, the typical practice is to place a transparent glass or plastic plate within a flange formed in the frame opening, place the artwork or other image-bearing flat article on the transparent plate, and place a backing member atop the artwork. To secure these layers in place within the frame, a plurality of fasteners are driven into the interior edge of the frame, so that the tails of the fasteners extend to impinge on the back surface of the backing member. The fasteners, which may comprise glazier points, staples, tabs, or brads are generally driven by hand, using either manual or power-assisted tools.

In a factory setting where power tools are available and jigs can be set up to facilitate assembly, it is economical and feasible to use a plurality of the fasteners mentioned above. However, for small-scale production, home use, and the like, the fasteners are difficult to drive into the frame, due to the small size of the components and the limited space available for manual maneuvering. A typical frame may require six to twelve fasteners. It is also difficult to place the fasteners accurately to define the required impingement on the backing member. Moreover, if it becomes necessary to remove the backing and replace the artwork, all of the fasteners must be bent upwardly to free the backing, and then bent back into place over the backing member. This process is difficult, and may loosen or break the fasteners, necessitating replacement. Thus the multiple fastener system is deficient in many respects.

There are known in the prior art various devices for securing the artwork and backing member compressively against the glazing of a picture frame. These devices generally are characterized as spring clips or clamps that are either insinuated between the frame and backing or joined to the frame and arranged to impinge on the backing. They typically require multiple components to join the assembly properly, and may require screws or nails driven into the frame itself. Loss or breakage of any component renders the system unworkable, and many of these devices are no easier to use (or re-use) than the staples, tabs, and brads known in the prior art.

There is clearly a need in the prior art for a simple system for assembling artwork in a frame that is easy to use, readily disassembled for replacement of the artwork in the frame, and comprised of a minimum number of parts.

SUMMARY OF THE PRESENT INVENTION

The present invention generally comprises a retainer device for securing artwork in a picture frame. The retainer device is a unitary component that is easily installed in a picture frame, readily removable for replacement of the artwork or glazing, and inexpensive to manufacture.

The retainer device of the invention includes a spring capable of engaging all four side rails of a picture frame in compressive fashion. The spring is formed in the configuration of a four pointed star, each point of the star joined to an adjacent point by a pair of diverging, arcuate, concave arms. All of the points and the joining arms are disposed in a common plane, and the points radiate from a common central area of the plane. The entire star configuration is formed of spring wire, plastic, or the like, and may be formed of a single piece of spring wire. The points of the star are each formed by a convex bend in the spring wire, the convex bend having a radius significantly smaller than the radii of any of the linking arms of the star. The spring wire is ground or otherwise formed to define a sharpened edge at the apex of each point of the star.

The four pointed star is dimensioned so that the length and width spacing of the points of the star is slightly greater that the length and width of the inner opening of the picture frame. The relatively large radii of the linking arms imparts a resilient flexibility to the star, so that the star may be deformed and compressed to fit within the opening of the back of the picture frame. The star-shaped device then springs outwardly, forcing the sharpened edges of the points into the inner surfaces of the frame. The retainer is placed so that it impinges directly on the exposed surface of the backing member, so that the backing member maintains the artwork in impingement against the glazing of the picture frame. This engagement will be maintained securely and indefinitely.

The retainer may be removed with little manual effort to replace the artwork or glazing. Grasping and squeezing the concave linking arms compresses the star shape of the retainer, releasing the points from the inner surfaces of the frame opening and immediately disengaging the retainer from the frame. Thus the device of the invention may be re-used many times, and, likewise, a picture frame assembly employing the invention may be re-assembled many times with differing combinations of artwork, glazing, and backing members.

DESCRIPTION OF THE PREFERRED EMBODIMENT

Figure 1:
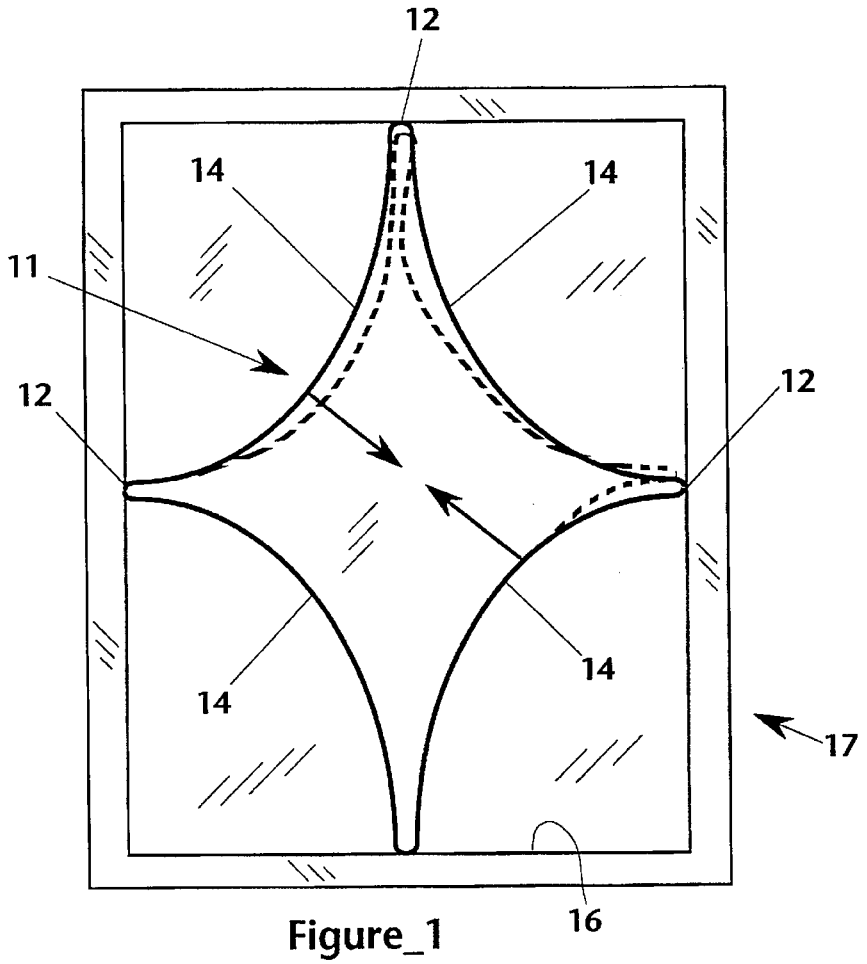
FIG. 1 is a plan view of the retainer device of the present invention, shown engaged in a typical picture frame assembly.

The present invention generally comprises a retainer device for securing artwork in a picture frame formed of wood or similar material. With regard to FIGS. 1–3, the retainer device 11 comprises a star-shaped member having a plurality of points 12. In the preferred embodiment the device includes four points related in a rectangular configuration, although fewer or greater number of points may be provided.

The star-shaped member is formed of plastic, spring wire or the like, and preferably of a unitary piece of wire or the like, or may be stamped or molded to define a thin, wire-like member 13 which is resiliently form-retaining and exhibits elastic resistance to deformation. Each point 12 is defined by a convex bend in the wire, the bend having a small radius and extending through approximately 180°. Extending from each point 12 are a pair of linking arms 14. The linking arms 14 diverge from each point 12 in an arcuate, concave configuration to join opposed, adjacent points 12. The radius of curvature of each arm 14 is substantially greater than the radii of curvature that define the points 12.

In the preferred embodiment the points 12 of the retainer 11 are spaced apart in opposed pairs. The spacing of the opposed points 12 corresponds to, and is slightly greater than, the respective length and width dimensions of the back opening 16 of a typical picture frame 17. As shown in broken line in FIG. 1, the retainer may be deformed by manually grasping and squeezing opposed arms 14 to temporarily decrease the spacing of the opposed points, so that the retainer 11 may be inserted into the back opening 16 of the frame 17. Alternatively, the retainer 11 may be rotated slightly eccentrically with respect to the length and width axes of the frame to install the retainer. In either case, the spring characteristic of the retainer that is imparted by the formation of the linking arms and the nature of the material from which they are formed drives the points 12 into the surface 16 to secure the retainer in the frame.

Figure 2:
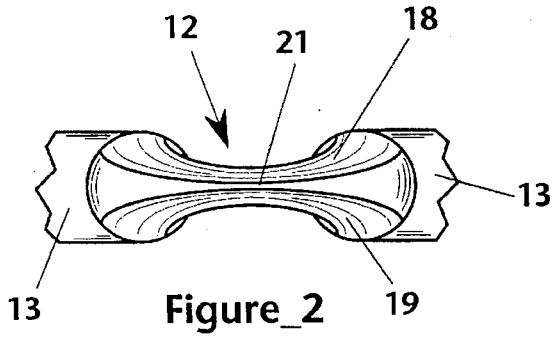
FIG. 2 is a magnified end view showing the sharpened edge of a point of the star-shaped retainer of the invention.

With particular regard to FIG. 2, the retainer further includes means for enhancing the engagement with the picture frame. The portions of the member 13 that are involved in the small radius bend which defines each point 12 are provided with tapering surfaces 18 and 19 that converge toward the distal end of the point to define a sharpened edge 21. This feature may be provided by grinding opposed surfaces of each point 12, or by molding or stamping the surfaces 18 and 19 when the retainer is manufactured. The sharpened edges 21 of the points 12 penetrate into the surface of the back opening 16 to prevent accidental release of the retainer from the frame. However, manually squeezing opposed arms 14 may effect easy release of the retainer when desired.

Figure 3:
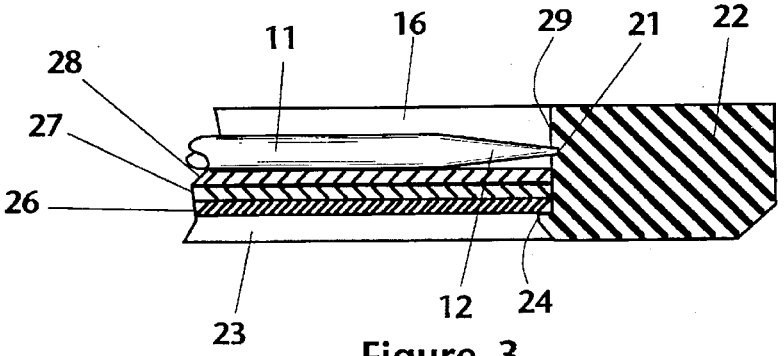
FIG. 3 is a magnified cross-sectional view of a portion of a typical picture frame assembly employing the retainer device of the present invention.

As shown in FIG. 3, a typical art or picture frame includes frame rails 22 which form a sight opening 23 at the front and the back opening 16. A flange 24 extends inwardly in the sight opening 23 to support a glazing panel 26 of glass or plastic. The artwork 27 is then placed on the back surface of the glazing 26, and a backing member 28 is placed over the artwork. (The backing member may be omitted when the artwork has sufficient structural stiffness to be self-supporting.) The retainer 11 of the invention is then placed in the back opening 16, and installed so that the retainer impinges compressively on the artwork assembly and holds in against the glazing 26. The resilient restoring force of the spring arms 14 drives the sharpened edges 21 of the points 12 to penetrate into the inner surface 29 of the frame rails 22, securing the retainer 11 and the artwork. As noted above, the retainer may be removed with little manual effort to replace the artwork or glazing. Grasping and squeezing the concave linking arms compresses the star shape of the retainer, releasing the points from the inner surfaces of the frame opening and immediately disengaging the retainer from the frame. Thus the device of the invention may be re-used many times, and, likewise, a picture frame assembly employing the invention may be re-assembled many times with differing combinations of artwork, glazing, and backing members. It should also be noted that the glazing panel may be omitted where the nature of the artwork obviates the need for protection of the artwork by the glazing panel.

We claim:

1. A retainer device for securing artwork in a picture frame having a plurality of sides, comprising;

a unitary spring member bent in a common plane to define a plurality of points in integral fashion, said plurality of points extending in a common plane and radiating outwardly from a central area of said common plane, said points adapted to engage all of the plurality of sides of the picture frame;

each of said points including a sharpened edge to engage and penetrate a respective side of the picture frame to removably secure said retainer device to the picture frame;

each of said plurality of points being defined by a bend in said spring member of approximately 180°; and, a plurality of pairs of linking arms formed by said spring member, each of said pair of linking arms extending from one of said plurality of points in diverging fashion, each of said linking arms having a concave arcuate configuration.

2. The retainer device of claim 1, wherein each of said bends incorporates a bend radius of curvature, each of said linking arms incorporates an arm radius of curvature, and said arm radius of curvature is substantially greater than said bend radius of curvature.

* * * * *